US006363575B1

(12) United States Patent
Käser

(10) Patent No.: US 6,363,575 B1
(45) Date of Patent: Apr. 2, 2002

(54) DOOR ACTUATING SYSTEM

(75) Inventor: Uwe Käser, Wiernsheim (DE)

(73) Assignee: GEZE GmbH & Co., Leonberg (DE)

( * ) Notice: Subject to any disclaimer, the term of this patent is extended or adjusted under 35 U.S.C. 154(b) by 0 days.

(21) Appl. No.: 09/446,716

(22) PCT Filed: Jun. 24, 1998

(86) PCT No.: PCT/DE98/01727

§ 371 Date: Mar. 28, 2000

§ 102(e) Date: Mar. 28, 2000

(87) PCT Pub. No.: WO98/59141

PCT Pub. Date: Dec. 30, 1998

(30) Foreign Application Priority Data

Jun. 24, 1997 (DE) ..... 197 26 741

(51) Int. Cl.[7] ..... E05F 1/08
(52) U.S. Cl. ..... 16/48.5
(58) Field of Search ..... 16/48.5, 49, 51, 16/52, 54; 292/164; 49/7

(56) References Cited

U.S. PATENT DOCUMENTS

| | | | | |
|---|---|---|---|---|
| 3,759,556 A | | 9/1973 | Wright | |
| 4,161,804 A | | 7/1979 | D'Hooge et al. | |
| 4,265,051 A | * | 5/1981 | Williams | 49/7 |
| 4,805,261 A | * | 2/1989 | Barchechat | 16/48.5 |
| 4,851,979 A | | 7/1989 | Degelmann | |
| 5,121,950 A | * | 6/1992 | Davidian | 292/164 |
| 5,187,835 A | * | 2/1993 | Lee | 16/52 |
| 5,529,148 A | * | 6/1996 | O'Leary | 16/49 |
| 5,709,009 A | * | 1/1998 | Lasson et al. | 16/48.5 |
| 5,864,920 A | * | 2/1999 | Lasson et al. | 16/48.5 |

FOREIGN PATENT DOCUMENTS

| | | | | |
|---|---|---|---|---|
| CH | 281690 | | 7/1952 | |
| DE | 33 12 382 | | 10/1983 | |
| DE | 34 11 576 | | 2/1985 | |
| DE | 36 38 353 | | 10/1987 | |
| DE | 40 02 747 | | 8/1991 | |
| DE | 195 15 169 | | 10/1995 | |
| GB | 2289311 A | * | 11/1995 | A62C/2/24 |
| GB | 2315808 A | * | 2/1998 | A62C/2/24 |

* cited by examiner

*Primary Examiner*—Lynne H. Browne
*Assistant Examiner*—Doug Hutton
(74) *Attorney, Agent, or Firm*—Crowell & Moring LLP

(57) ABSTRACT

A door actuating system for the leaf of a fire door includes a safety fuse that detaches the fixture between the housing of the door actuating system and an arm on the door or the door frame, which then falls on the floor and are no longer in contact with the hot surface of the door. Plastic screws and plastic bushings accomodating metals screws or assembly plates made of plastic or similar materials can be used as the safety fuse.

23 Claims, 4 Drawing Sheets

DOOR ACTUATING SYSTEM

BACKGROUND AND SUMMARY OF INVENTION

The invention relates to a door closer.

Door closers are known which have closing springs as energy accumulators and hydraulically damped closing motion, in which the closing spring cooperates with a hydraulic piston-and-cylinder unit. The piston-and-cylinder unit and the closing springs are disposed in a housing and act through a rack and a pinion or through cam drives with a closing shaft journaled in the housing, which is connected directly or through a force-transmitting linkage to the door. When the door is opened manually the energy accumulator is charged and then discharged by the automatic closing of the door. In each opening and closing of the door the operation of the piston exchanges hydraulic fluid between the two piston working chambers. A manual door closer constructed in this manner is disclosed, for example, in DE 36 38 353 A1.

In closers of this kind, scissors rods or sliding arm rods are used in practice as the force-transmitting linkages. There are closers which are mounted on the door leaf or on the frame.

The use of such known hydraulic door closers on fire doors is not free of problems on account of the flammability of the hydraulic fluid. Heretofore it has been necessary to assure that a closer mounted on the side of a door that faces away from the fire does not become leaky even when greatly heated by a fire. Leaking hydraulic oil would catch fire directly on a hot door and threaten further propagation of the fire. On account of such stringent requirements regarding leakage the manufacture of the door closers is relatively complex. Also, the use of low-melting materials such as plastic in the door closer housing has been prohibited.

In DE 195 15 169 A1 it is proposed to use fusible fasteners in the form of fusible plastic screws for mounting door closers on the side of fire doors facing away from the fire if a fire occurs, so that in case of fire the fastener will melt and the door closer will fall from the door. This means, therefore, that the door closer will fall from the door before the door closer housing becomes hot on the hot door in case of fire. If the door closer should remain on the hot door, the result could be that the door closer housing fastened to the door might burst and the oil in the housing might run out and/or start to burn and/or burn on the door.

The invention is addressed to the problem of developing a door closer which can be used also on fire doors and which can be installed easily and securely.

This problem is solved according to the invention by a door actuating system for the door of a fire doorway, comprising (1) a driver housing; (2) at least one of (a) a motor driving device with an outside energy source disposed in the driver housing for opening and closing the door or (b) a restoring device disposed in the driver housing that is energized when the door is opened and is designed as an energy accumulator for the automatic closing of the door; (3) a damping device disposed in the driver housing for damping at least one of a closing or an opening movement of the door; (4) an output means journaled in the driver housing and cooperating with at least one of the motor driving device, the restoring device, or the damping device; and (5) a force-transmitting linkage connected to the output means and supported in a rotary bearing or a slide bearing. The rotary bearing or the slide bearing is fastened to the door or to a fixed door frame through a fastener. The driver housing is fastened to the fixed door frame and to the door through a mounting device. The mounting device has on the door and door frame a heat-conducting fastener that melts at temperatures greater than 500° C. The heat-conducting fastener is disposed in an area of a fusible safety device, which in case of fire melts and releases the fastening of the driver housing on the door and on the door frame. The driver housing may have a separate mounting plate or one formed in one piece with the housing that comprises a plastic material.

The release of the fastening prevents the door closer or an inflammable medium in the door closer from catching fire on the hot door on the side of the door facing away from the fire. Inflammable mediums may be contained, for example, in gearing, couplings and damping devices.

This inflammable medium may be a hydraulic oil or a hydraulic damping device, a hydraulic drive or a hydraulic coupling, as well as other inflammable media suitable for use in such devices.

The use of the highly heat-conducting fastener assures that, in case of fire, the fusible device will melt if the heat is sufficient, and that the door closer housing can come loose—fall, for example—automatically from the door or door frame. Preferably plastic is used in making the fusible device. However, a low-melting metal can also be used, e.g., one melting at less than 300° C.

The fastener, which is made of material of high thermal conductivity and not melting or melting only at a high temperature greater than 300° C., especially greater than 500° C., can be made of metal, especially copper or steel.

The high thermal conductivity of the fastener assures that, in case of fire, the transfer of heat from the hot door to the fusible device will be high, i.e., much heat is transferred to melt the fusible device quickly and surely.

At room temperature the fusible device provides a force-transmitting connection between the closer housing and the door and the door frame. At temperatures above 300° C. the plastic starts to melt. The fastening of the closer housing thus also is released. The desired melting temperature can be selected by choosing the appropriate plastic or by varying its composition in the appropriate manner.

It is especially advantageous in this connection if the closer housing and/or a mounting plate of the closer housing is made from weakly heat-conductive material, e.g., of plastic, asbestos or substitutes, ceramic, glass or materials compounded of these substances, in order to assure that the medium in the closer housing, oil for example, is slowly and not greatly heated. Thus any heating of the oil and bursting of the closer housing is at least delayed, and preferably prevented, as long as the closer housing is mounted on the door when hot in the case of fire.

Also the fastening device of the sliding or rotating joint in which the force-transmitting linkage is supported on the door or door frame should advantageously release in case of fire. This is accomplished, for example, by the automatic unhooking of the connection to the closer housing as soon as the latter is released from the door or door frame, or preferably by the sliding or rotating joint's own fusible device. In case of fire, the drive housing and linkage will thus drop together and early to the floor before the door closer or its housing and the oil becomes hot. Without the direct contact to the door surface there is no longer any danger that hydraulic oil will catch fire.

In a first embodiment, the mounting screws of the mounting device with which the closer housing and the sliding or rotating joint is mounted on the door or door frame is made of metal.

In a modified embodiment, the fusible device has collars of plastic which are held in mounting bores of the closer housing or of the rotary or sliding bearing.

The outside diameter of the collars is greater than the diameter of the head of the mounting screw, so that the bores in the closer housing or in the rotary or sliding bearing let the screw heads pass through them as soon as the collars melt in case of fire.

In an additional embodiment, the closer housing or rotary or sliding bearings are fastened on mounting plates of a good thermal insulating material or low-melting material, e.g., plastic. The mounting plates are fastened in turn on the door or door frame. The closer housing mounting screws, consisting of material of good thermal conduction enter only into the mounting plate, but not into the door frame or door. In case of fire, when the mounting plates melt in the area of the screws of good thermal conduction, the closer housing and rotary or sliding bearings lose their hold and fall to the floor.

Alternatively, the closer housing and/or the force-transmitting linkage and/or the rotary or sliding bearing can be made in whole or in part of highly thermal insulating and/or low-melting material, such as plastic. In this case other thermal insulating and/or low-melting mounting plates or the like can be dispensed with. Through the use of plastic for housing and linkage a good thermal insulation from the door made hot by the fire is achieved, so that the heating of the medium in the closer housing takes place but very slowly.

The housing of the closer can consist of thermal insulating material, but also of metal, especially if a mounting plate of thermal insulating material is used.

BRIEF DESCRIPTION OF THE DRAWINGS

The invention is further explained in the figures, wherein.

DETAIL DESCRIPTION OF THE DRAWINGS

Figure 1:
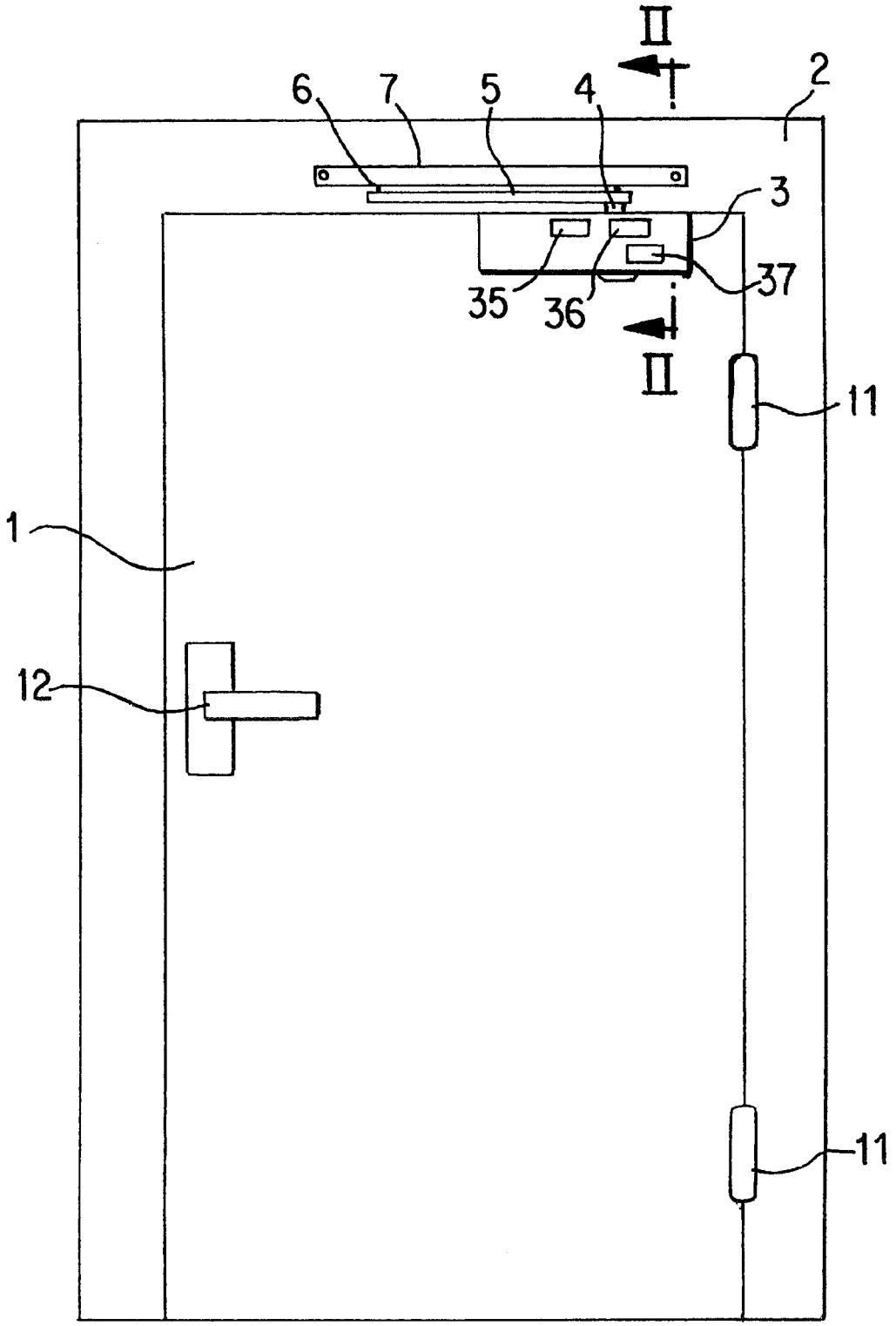
Fig. 1 PRIOR ART
FIG. 1 is a diagrammatic front elevation of a door with a horizontally mounted sliding arm door closer.

FIG. 1 shows a diagrammatic front elevation of a doorway. The doorway has a door 1 which is hung on hinges 11 attached to a vertical door post of a fixed door frame 2. The door 1 is equipped with a flat-mounted sliding arm door closer 3.

The sliding arm door closer 3 consists of a housing 31 in which a closing shaft 4 is journaled. A slide arm 5 is co-rotationally fixed to the closer shaft 4 and has on its free end a slider 6 which is displaceable and rotatable in a slide rail 7. In the door closer housing 31, a closing spring 35 and a damping device 36, which cooperates with the closing shaft 4, are arranged. The sliding arm door closer 3 can be a conventionally designed door closer 3, such as a hydraulic door closer 3 as described in DE 36 38 353 A1. When the door 1 is opened manually, the forced movement of the linkage and the closing shaft 4 act on the closing spring. The closing action then takes place automatically by the action of the closing spring, while hydraulic medium is exchanged via hydraulic passages and valves between the two piston chambers of the piston-and-cylinder system.

In the kind of installation represented in FIG. 1, the so-called on-the-door mounting, the door closer housing 31 is mounted on the door, while the slide rail 7 is mounted on the door frame. In another kind of installation not shown, called door-frame mounting, the door closer housing 31 is mounted on the door frame 2 and the slide rail 7 on the door 1. The closer can be installed either on the hinge side, as shown in FIG. 1, or on the side opposite the hinge.

In an alternative embodiment, a scissors type of linkage can be used. The invention can also be used on double doors, which can additionally be equipped with a door closing sequence control. Also, the invention can be used on electrohydraulic door closers which also have a motor driving device 37 such as a hydraulic pump disposed in the drive housing for motor-driven opening or motor-assisted opening of the door 1. In the following figures the explanation of the various embodiments of the invention will be given always with reference to the hydraulic door closer 3 already described.

Door closers or door drivers 3 for use on fire doors have heretofore had to be designed so that, even in the event that the door closer 3 should become extremely heated, no hydraulic medium can escape. Particularly those areas of the door which serve for mounting the door closer 3, namely the door frame 2 and the door edges, serve as heat bridges when the door is closed. Even on the side facing away from the fire the surface temperature of the door at these points can reach 300° C. to 400° C. Hydraulic oil escaping through a leaky point would immediately catch fire and help to spread the fire.

According to the invention, ignition of hydraulic medium is prevented because the door closer 3 or door driver 3 breaks entirely away from the "hot" door in case of fire. For this purpose the device for fastening the driver housing and the device for fastening the linkage 5, 6, 7 cooperates with a fusible device which at room temperature assures a stable attachment of the door closer or door driver 3, but at temperatures of about 300° C. it melts and detaches it. Since the driver housing 31 would continue to be pressed against the hot door by the force of the linkage, the unfastening of the linkage is likewise advantageous. Four alternative embodiments of the invention are set forth below. FIGS. 2 to 5 each show a section along line II—II in FIG. 1.

Figure 2:
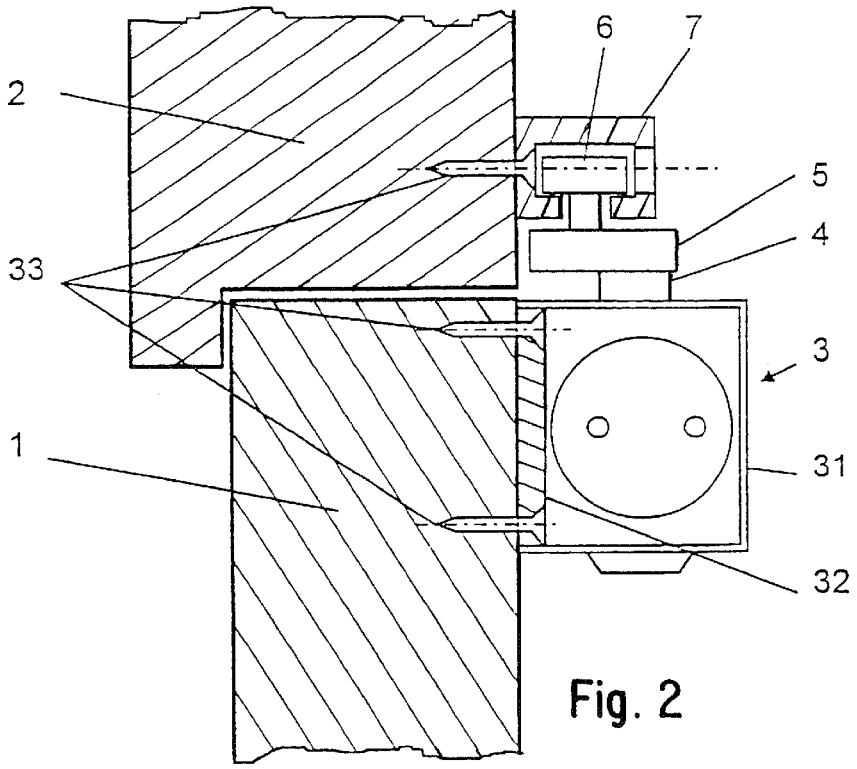
FIG. 2 a section along line II—II in FIG. 1 with the door closer fastened with plastic screws.

FIG. 2 shows a cross section in the area of the fastening device of a hydraulic door closer 3. The drive shaft 4 of the door closer 3 is carried through a sliding arm linkage 5 with a slider 6 in a track 7 fastened on the door frame. The track 7 is screwed at its axial extremities onto the door frame 2 by screws 33.

The drive housing 31 mounted on the door is equipped at both its ends with a mounting base 32. Each of the two mounting bases 32 has two bores to accommodate screws 33 which serve to fasten the drive housing 31 on the door 1.

Both the screws 33 of the drive housing 31 and those of the track 7 are made of plastic and designed as fusible fasteners. At temperatures above 300° C., such as occur in case of fire on the side of the fire door racing away from the fire, the plastic melts and loses its hold. Then the track 7 and the door driver housing 31 including the linkage 5, 6, 7 drop of their own weight from the door frame 2 and door 1 and fall to the floor. Without direct contact with the hot door surface there is no longer any danger on the side of the door facing away from the fire that any hydraulic oil will ignite. On the fire side, however, it is quite possible that even a door closer 3 lying on the floor might catch fire. This, however, signifies no endangerment, since in this case the fire is unable to reach the door side facing away from the fire.

Figure 3:
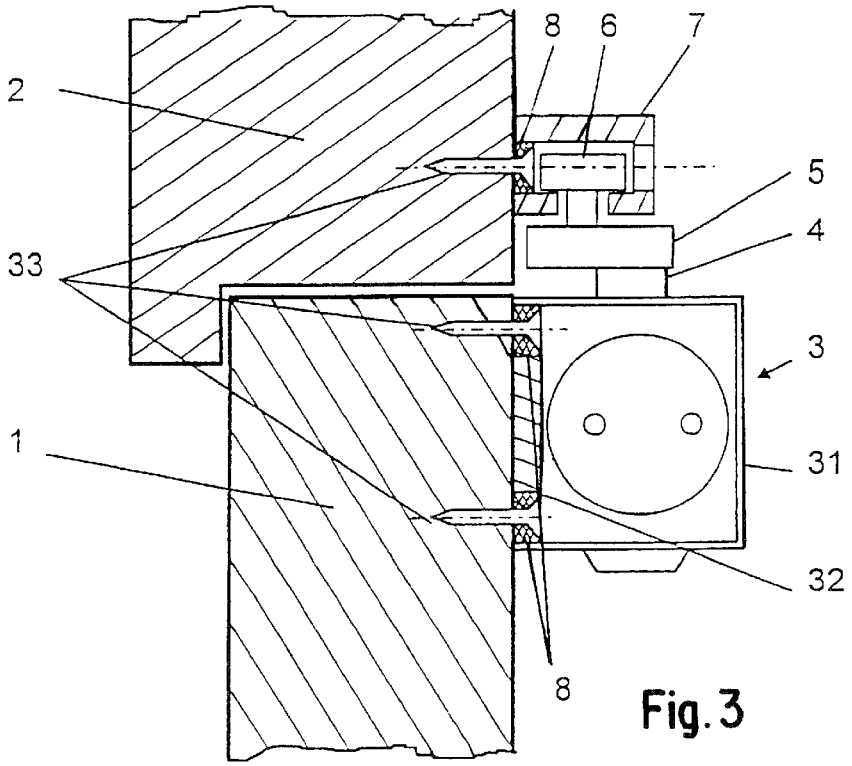
FIG. 3 a section along line II—II in FIG. 1 wherein the door closer is secured through plastic collars.

FIG. 3 shows a modification of FIG. 2. The bores that are to receive the screws 33 in the track 7 and in the bases 32 of the driver housing 31 are each provided with plastic collars 8. The plastic collars 8 in turn contain the screws and serve as fusible devices. The collar diameter is consequently made greater than the diameter of the screw head. The screws are made of highly thermoconductive material, metal, for example, especially copper or steel, which in case of fire carry much heat quickly to the plastic collars serving as fusible devices.

In case of fire, the plastic collars 8 in this embodiment melt in the mounting holes of track 7 and drive housing 31 and then let the screw heads through. As described in FIG. 2, the track 7 and the door drive housing 31 including the linkage 5, 6, 7 then fall to the floor. If the screws are of metal, they remain in the door 1 and door frame 2.

Figure 4:
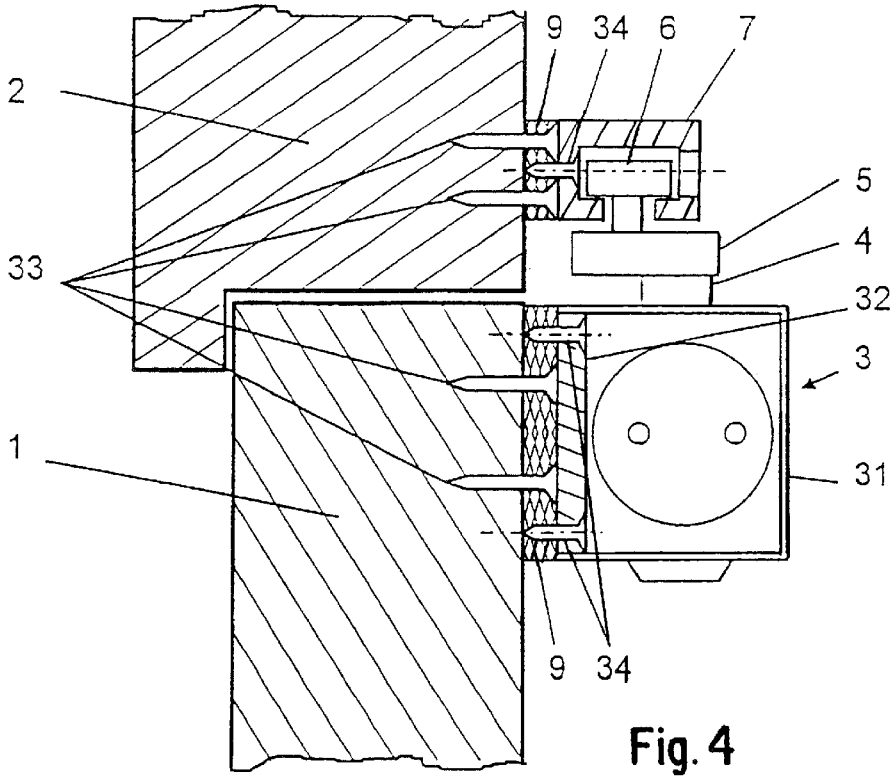
FIG. 4 a section along line II—II in FIG. 1 with the door closer installed on mounting plates of plastic, FIG. 5 a section along line II—II in FIG. 1 of a door closer with plastic housing and plastic slide rail.

FIG. 4 shows another alternative embodiment, which is especially suitable for retrofitting to door closers 3 already on hand. In this case both the track and the driver housing 31 are fastened to the door frame 2 and door 1 on mounting plates 9 of highly heat-insulating and low-melting plastic. Track 7 and driver housing 31 are fastened on the mounting plate 9 by highly heat-conducting and non-melting metal screws. The screws 34 are driven only into the mounting plate 9, but not into the door frame 2 or door 1. The mounting plates 9 are in turn attached with screws 33 of metal to the door frame 2 and door 1. In case of fire the mounting plates 9 serve as fusible devices. The screws 34 for fastening the driver housing 31 and track 7 lose their hold when the mounting plate 9 melts away and, as already described in FIG. 2, the track 7 and the door driver housing 31 including the linkage 5, 6, 7 fall to the floor. The reliable and complete melting of the safety member is assured by the high heat conduction of the screws.

Figure 5:
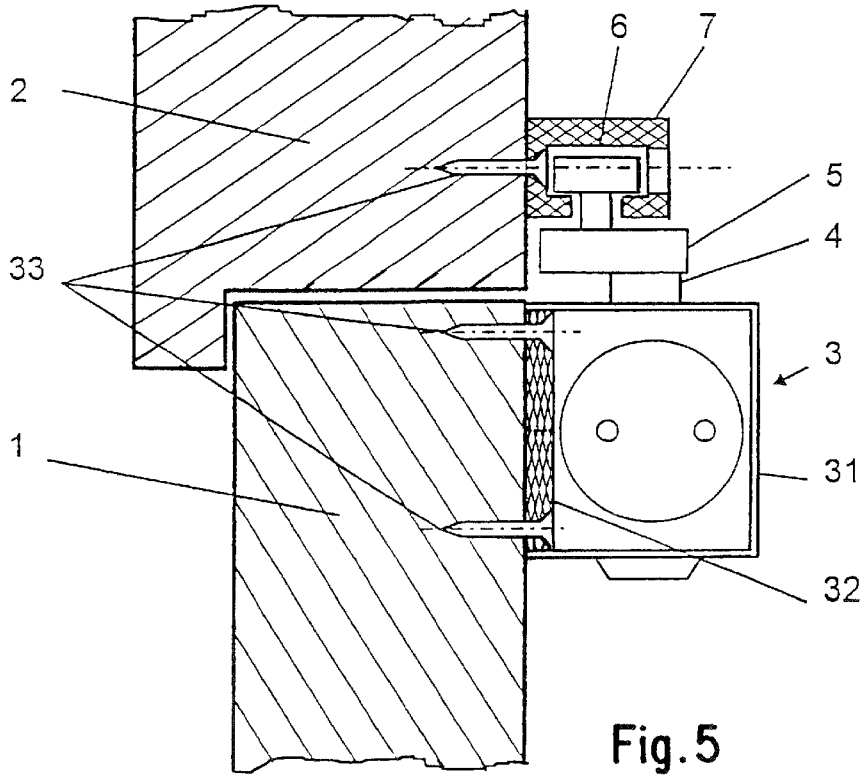
Figure 6:
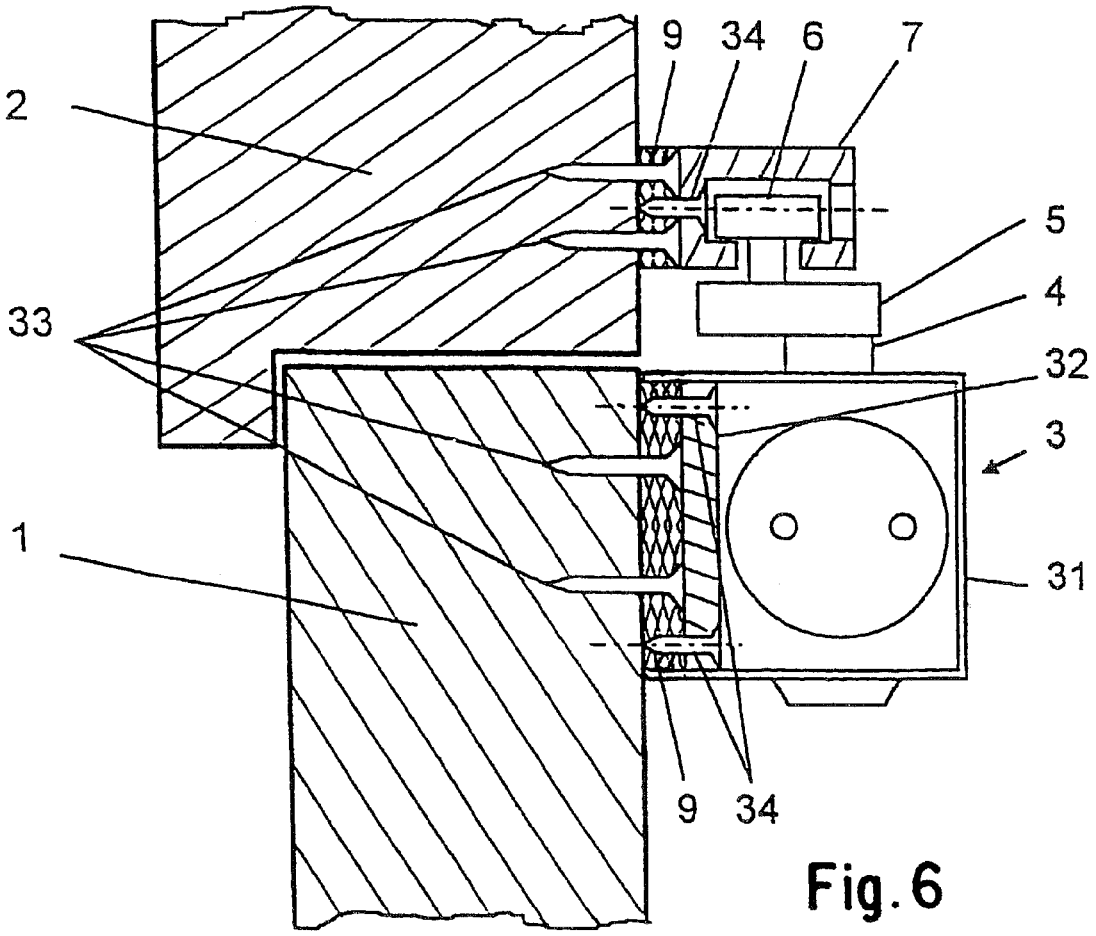
FIG. 6 is a drawing of a door closer in which a mounting plate is formed in one piece with the door housing.

In the embodiment shown in FIG. 5, both the track 7 and the mounting feet of the door driver housing 31 are made of plastic and screwed to the door frame 2 and door 1 conventionally by means of metal screws 33. In case of fire the track 7 and mounting feet 32 act as fusible devices. As already described in FIG. 2, the slide 7 and the door driver housing 31 including the linkage 5, 6 and 7 drop to the floor as soon as the track 7 and mounting feet 32 melt due to the heat and the screws 33 thus lose their hold. In this embodiment too, the highly heat-conductive and infusible screws provide for the reliable and fast melting away of the fusible material around the screws.

In a further embodiment not shown it is possible to make the entire driver housing 31 and not just its mounting feet of plastic. For use as fusible means 8, 9 and 33, not only plastic is possible, but other materials are appropriate which offer sufficient mechanical stability and workability as well as a low melting point.

The mounting system with the fusible devices proves similarly advantageous in all drivers which operate with a flammable medium when used on fire doors. Such media can be hydraulic oil, as described before, but also other media are conceivable. The media can be used for damping door movement, as described above, in a damping device, for example, using a piston-and-cylinder system. But embodiments are also possible which have hydraulic clutches or hydraulic drives or clutches and drives with other flammable media.

Through the use of materials of great heat insulating properties in the driver housing and for the mounting plate, it is brought about in all of the exemplary embodiments that in case of fire the heating of the oil in the driver housing is reduced, or at least retarded, thereby combating the bursting of the housing and the escape of oil.

What is claimed is:

1. A door actuating system for the door of a fire doorway, comprising:

a driver housing fastened to a door frame and to the door through a mounting device;

at least one of a motor driving device disposed in the driver housing for opening and closing the door or a restoring device disposed in the driver housing that is energized when the door is opened and is designed as an energy accumulator for automatic closing of the door;

a damping device disposed in the driver housing for damping at least one of a closing or an opening movement of the door;

an output means journaled in the driver housing and cooperating with at least one of the motor driving device, the restoring device, or the damping device;

a force-transmitting linkage connected to the output means and supported in a rotary bearing or a slide bearing, wherein the rotary bearing or the slide bearing is fastened to the door or to the door frame through a fastener;

a heat-conducting fastener for fastening the mounting device to the door and door frame and does not melt or only melts at temperatures greater than 500° C., wherein the heat-conducting fastener is disposed in an area of a fusible safety device, which in case of fire melts, thereby releasing the driver housing.

2. A door actuating system according to claim 1, wherein the restoring device is a closing spring.

3. A door actuating system according to claim 1, wherein the damping device is a hydraulic damping device.

4. A door actuating system according to claim 1, wherein the output means is an output shaft.

5. A door actuating system according to claim 1, wherein the fastener comprises a metal.

6. A door actuating system according to claim 1, wherein the fastener for a rotary bearing or a sliding bearing comprises a heat-conducting fastener that is disposed in the area of another fusible safety device, which in case of a fire melts, thereby releasing the rotary or sliding bearing.

7. A door actuating system according to claim 6, wherein the fastener is a metal fastener.

8. A door actuating system according to claim 7, wherein the fusible safety device comprises a safety collar contained in a mounting hole in the driver housing or of the rotary or sliding bearing, and wherein an outside diameter of the safety collar is greater than a diameter of the head of the screw.

9. A door actuating system according to claim 8, wherein the safety collar comprises a plastic material.

10. A door actuating system according to claim 1, wherein the fusible safety device comprises a mounting plate fastened on the door and door frame through first fastening means, and wherein the driver housing is fastened on the mounting plate through second fastener means, wherein the second fastener means engages only the mounting plate and not the door and door frame.

11. A door actuating system according to claim 10, wherein the mounting plate comprises at least one of a heat-conducting material or a low-temperature melting material.

12. A door actuating system according to claim 10, wherein the mounting plate comprises a plastic material.

13. A door actuating system according to claim 10, wherein the at least one of the first and second fastening means comprises a heat-conducting fastener.

14. A door actuating system according to claim 1, wherein the fusible safety device comprises a mounting plate fastened on the door and door frame, wherein the rotary or sliding bearing is fastened on the mounting plate through second fastener means, wherein the second fastener means engages only the mounting plate and not the door and door frame.

15. A door actuating system according to claim 1, wherein the driver housing at least partially comprises a plastic material.

16. A door actuating system according to claim 1, wherein the driver housing at least partially comprises a material selected from the group consisting of ceramic, asbestos, glass, and mixtures thereof.

17. A door actuating system according to claim 1, wherein the force-transmitting linkage at least partially comprises a plastic material.

18. A door actuating system according to claim 1, wherein at least one of the rotary or sliding bearing at least partially comprises a plastic material.

19. A door actuating system according to claim 1, wherein the driver housing further comprises a separate mounting plate or one formed in one piece with the housing that comprises a plastic material.

20. A door actuating system according to claim 1, wherein the driver housing further comprises a one-piece mounting device.

21. A door actuating system according to claim 20, wherein the one-piece mounting device is selected from the group consisting of mounting feet, mounting projections, and a mounting surface.

22. A door actuating system according to claim 20, wherein the one-piece mounting device comprises a plastic material.

23. A door actuating system according to claim 20, wherein a mounting side of the driver housing has a thickened wall or thickened feet.

* * * * *